US008490844B2

(12) United States Patent
Favorito et al.

(10) Patent No.: US 8,490,844 B2
(45) Date of Patent: Jul. 23, 2013

(54) FRONT INFANT CARRIER

(75) Inventors: Julia Favorito, Buffalo, NY (US); Cynthia R. Nelson, Longmont, CO (US); Lynn Rosen, Parker, CO (US)

(73) Assignee: Gold Bug, Inc., Aurora, CO (US)

( * ) Notice: Subject to any disclaimer, the term of this patent is extended or adjusted under 35 U.S.C. 154(b) by 210 days.

(21) Appl. No.: 12/848,693

(22) Filed: Aug. 2, 2010

(65) Prior Publication Data

US 2011/0186605 A1 Aug. 4, 2011

Related U.S. Application Data

(60) Provisional application No. 61/230,543, filed on Jul. 31, 2009.

(51) Int. Cl.
*A47D 13/02* (2006.01)

(52) U.S. Cl.
USPC ..... 224/160; 224/159

(58) Field of Classification Search
USPC ..... 224/159–160; D3/214
See application file for complete search history.

(56) References Cited

U.S. PATENT DOCUMENTS

| | | | | |
|---|---|---|---|---|
| 2,643,803 | A * | 6/1953 | Bates | 224/254 |
| 4,434,920 | A * | 3/1984 | Moore | 224/160 |
| 4,469,259 | A * | 9/1984 | Krich et al. | 224/160 |
| 5,490,620 | A * | 2/1996 | Bergqvist | 224/160 |
| 5,732,861 | A * | 3/1998 | Jakobson | 224/160 |
| 7,210,605 | B2 * | 5/2007 | Willows et | 224/637 |
| 7,284,503 | B2 * | 10/2007 | Elmberg | 119/770 |
| 2005/0242136 | A1 * | 11/2005 | Moriguchi et al. | 224/160 |
| 2006/0011678 | A1 * | 1/2006 | Kassai et al. | 224/160 |
| 2006/0130220 | A1 * | 6/2006 | Morgan et al. | 2/456 |
| 2006/0260057 | A1 * | 11/2006 | Dunn et al. | 5/655 |
| 2007/0138218 | A1 * | 6/2007 | Calilung et al. | 224/160 |
| 2008/0190972 | A1 * | 8/2008 | Gray | 224/160 |
| 2009/0001801 | A1 * | 1/2009 | Gold et al. | 297/452.47 |
| 2010/0072236 | A1 * | 3/2010 | Parness et al. | 224/161 |
| 2010/0108727 | A1 * | 5/2010 | Lundh | 224/160 |
| 2012/0187162 | A1 * | 7/2012 | Bergkvist et al. | 224/160 |

FOREIGN PATENT DOCUMENTS

| | | | |
|---|---|---|---|
| EP | 611234 | A1 * | 8/1994 |
| WO | WO 2008097161 | A1 * | 8/2008 |

* cited by examiner

*Primary Examiner* — Nathan J Newhouse
*Assistant Examiner* — John Cogill
(74) *Attorney, Agent, or Firm* — Ellen Reilly

(57) ABSTRACT

A front infant carrier having a front support pouch with dual side support flaps secured to a back support member, a lower portion of the front support pouch secured to a waist band, the waist band secured to continuous dual straps that are linked to the back support member.

18 Claims, 18 Drawing Sheets

FRONT INFANT CARRIER

CROSS REFERENCE TO RELATED APPLICATION

The present application is a utility conversion of provisional patent application Ser. No. 61/230,543 filed 31 Jul. 2009, for FRONT INFANT CARRIER, by Julia Favorito, Lynn Rosen and Cynthia R. Nelson and herein incorporated by reference.

The following relates to an infant carrier and more particularly relates to a novel and improved front infant carrier having self adjusting straps and airflow properties for ventilation.

BACKGROUND AND FIELD

Infants are often carried next to the body of an adult in an infant carrier and many carriers have been designed to accomplish this result while attempting to minimize the stress and fatigue that can result from carrying an infant. Often the wearer of the carrier becomes fatigued and suffers back pain as a result of carrying the infant in a front carrier. Further, the carriers are often difficult to assemble and put on, uncomfortable to wear for extended periods of time due to uneven weight distribution of the infant and must be completely disassembled in order to remove the infant.

An infant carrier has been devised in which a frontal pouch made of a light flexible, breathable fabric for placement of an infant therein is secured to a user with a linking back support member. The front pouch is defined by a padded continuous panel, the continuous panel having dual side support flaps extending outwardly from and located on opposite sides of the continuous panel for attachment to the back support member. The front pouch also has upper wing members along opposite sides of the front carrier, the wing members may be secured to the dual side support flaps and a lower waist band, which is secured to a lower portion of the front pouch, has continuous adjustment straps secured to the back support member. The front support pouch is secured to the back support member with releasable clip members and a modified waist belt that allows the wearer of the front carrier to place an infant within the pouch and finalize attachment of the pouch to the support system with a single hand. A rear panel of the support system is designed to evenly distribute the weight of the infant along the shoulders and back of a wearer while promoting proper posture of the wearer as well. An infant may be placed securely within the pouch in a forward or rearward facing position. The above and other features will become more readily appreciated and understood from a consideration of the following detailed description of different embodiments when taken together with the accompanying drawings in which:

DETAILED DESCRIPTION

Figure 6:
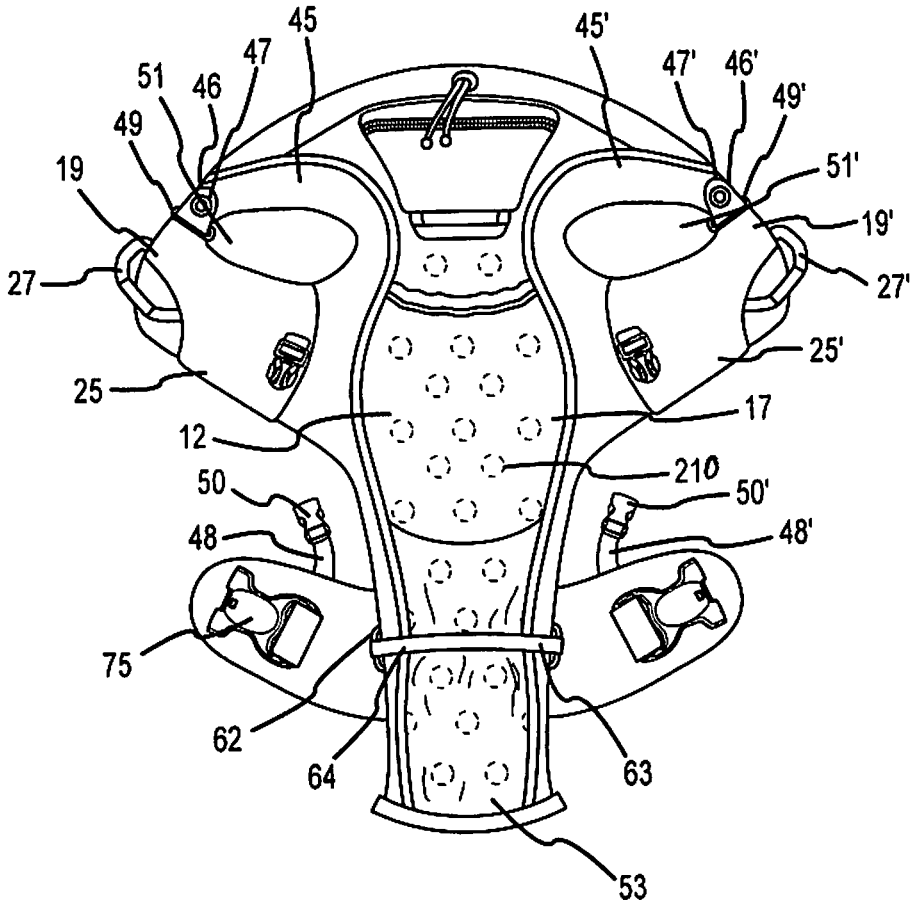
FIG. 6 is a front view of a front carrier portion of FIG. 1.
Figure 9:
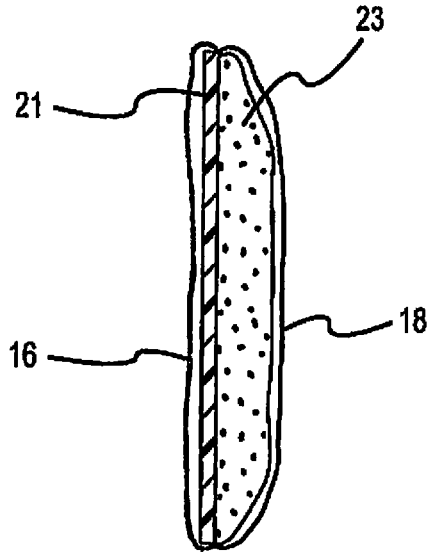
FIG. 9 is a sectional view of the side support flap of FIG. 5.
Figure 10:
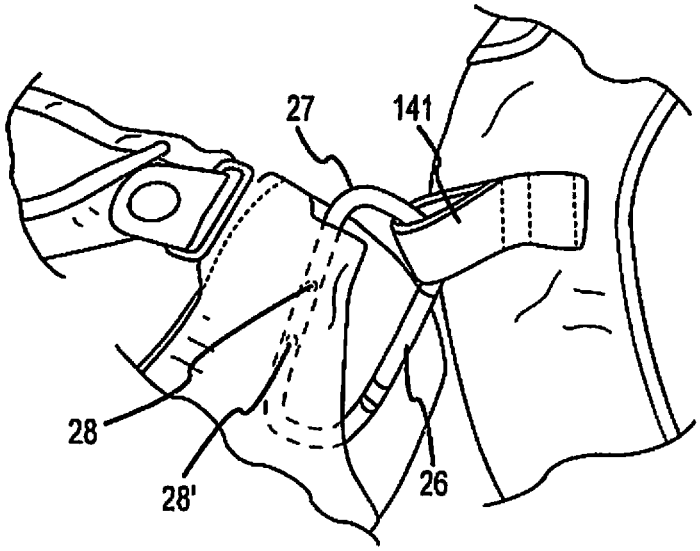
FIG. 10 is a side cut away view of a clip of the infant carrier of FIG. 1.

Referring in detail to the drawings 1-18 there is shown a front infant carrier 11 having a front support or pouch portion 13 for holding of an infant and a back support member 15 to be secured around a wearer, typically an adult user. The combination front support pouch 13 and back support member 15 is symmetrical about a vertical axis, having at least four points of contact between the front support pouch and the back support member. The front infant carrier 11 includes a number of adjustment features to accommodate small and large infants as well as a variety of adult users for the back support member. The front support pouch has a continuous panel 17, as shown in FIG. 6, including a moderate amount of padding 12 throughout and an interior or inner breathable mesh cover 16 and an exterior or outer fabric cover 18 to provide ventilation. The padding consists of foam or spongy material which has a series of openings or perforations 210 extending through the padding 12 at uniformly spaced intervals, which are covered by the inner and outer covers 16 and 18. In this way, the most critical area in terms of open ventilation is covered by the mesh material 16 to permit the free passage of air through the openings or perforations. The continuous panel 17 has dual side support flaps 19, 19' extending outwardly from and located on opposite sides of the continuous panel. The side support flaps include a moderate amount of padding 23 and reinforcing panels 21 between the inner and outer layers 16 and 18 as shown in FIG. 9. The reinforcing panels 21 are preferably made of a resilient plastic and are located between the padding 23 and the outer cover 18 so that a layer of padding 23 separates the panels 21 from the infant but other configurations are operable as well. The dual side support flaps 19, 19' also have covers 25, 25' that extend almost the full length and width of the side support flaps 19, 19'. Located beneath the covers 25, 25' are attachment members 27, 27', in this case a metal snap hook or link which will hereinafter be referred to as a carabiner, as shown in FIG. 10 with the gate arm 26 capable of being attached to a webbed loop 141 located on the back support member 15. The carabiners are non-releasably secured to the side support flaps with dual rivets 28, 28' for each carabiner. Other forms of attachment members may be utilized without departing from the scope of the carrier.

Figure 7:
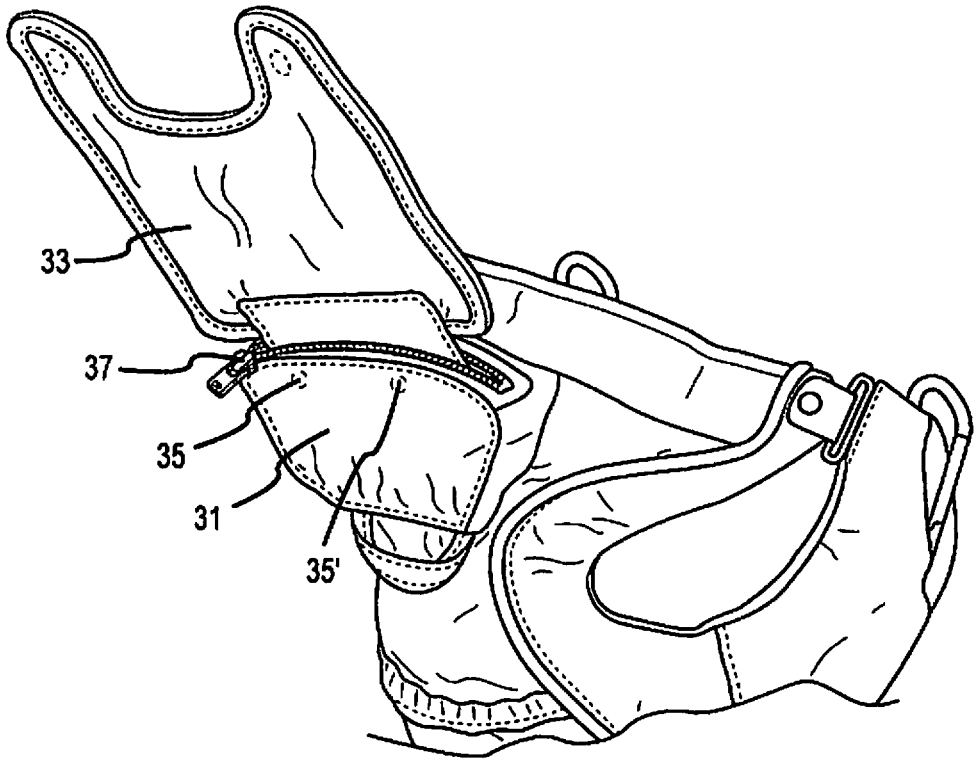
FIG. 7 is a side perspective cut away view of FIG. 5.
Figure 16:
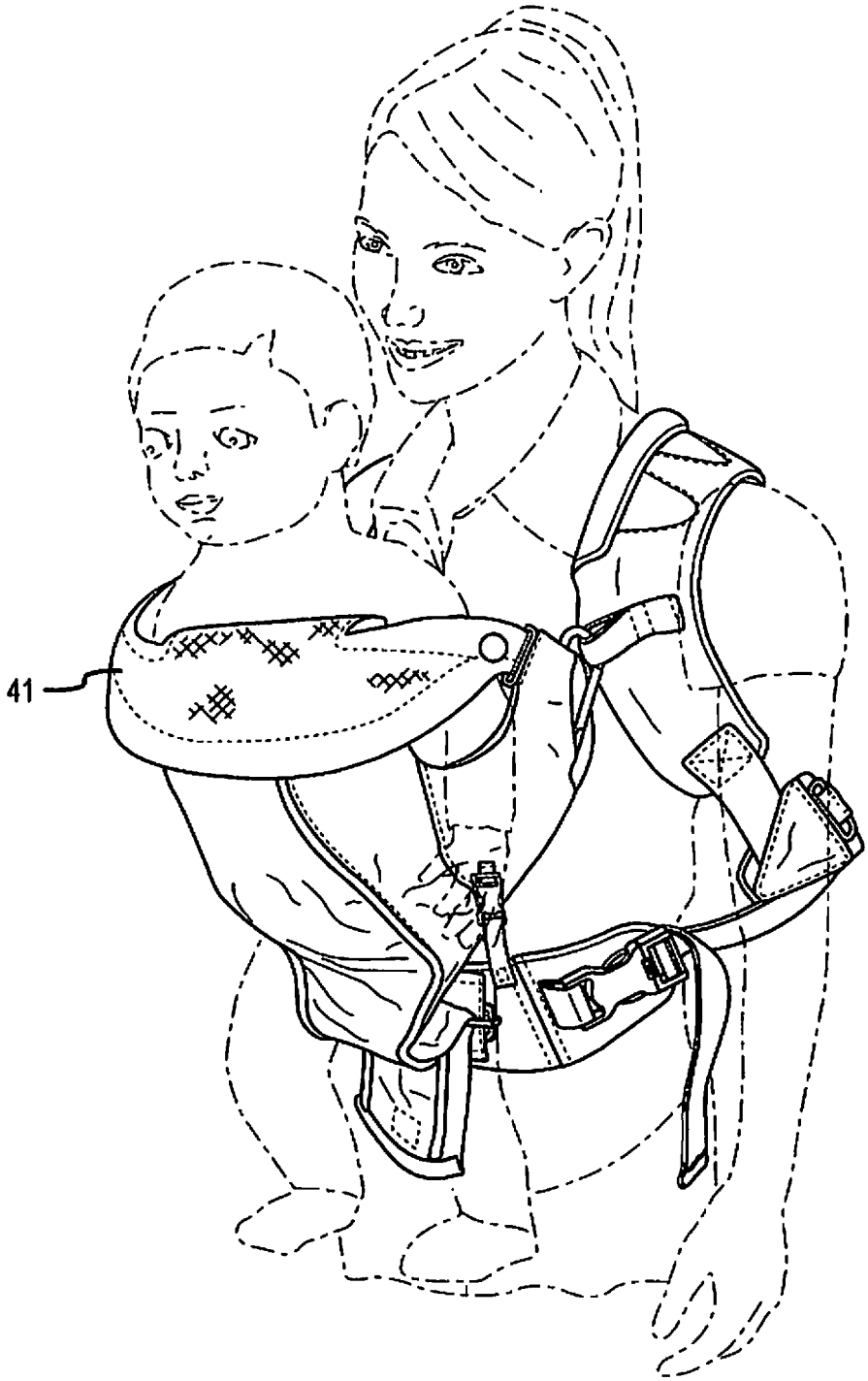
FIG. 16 is a perspective view of the front infant carrier of FIG. 1 demonstrating a use of the carrier.
Figure 17:
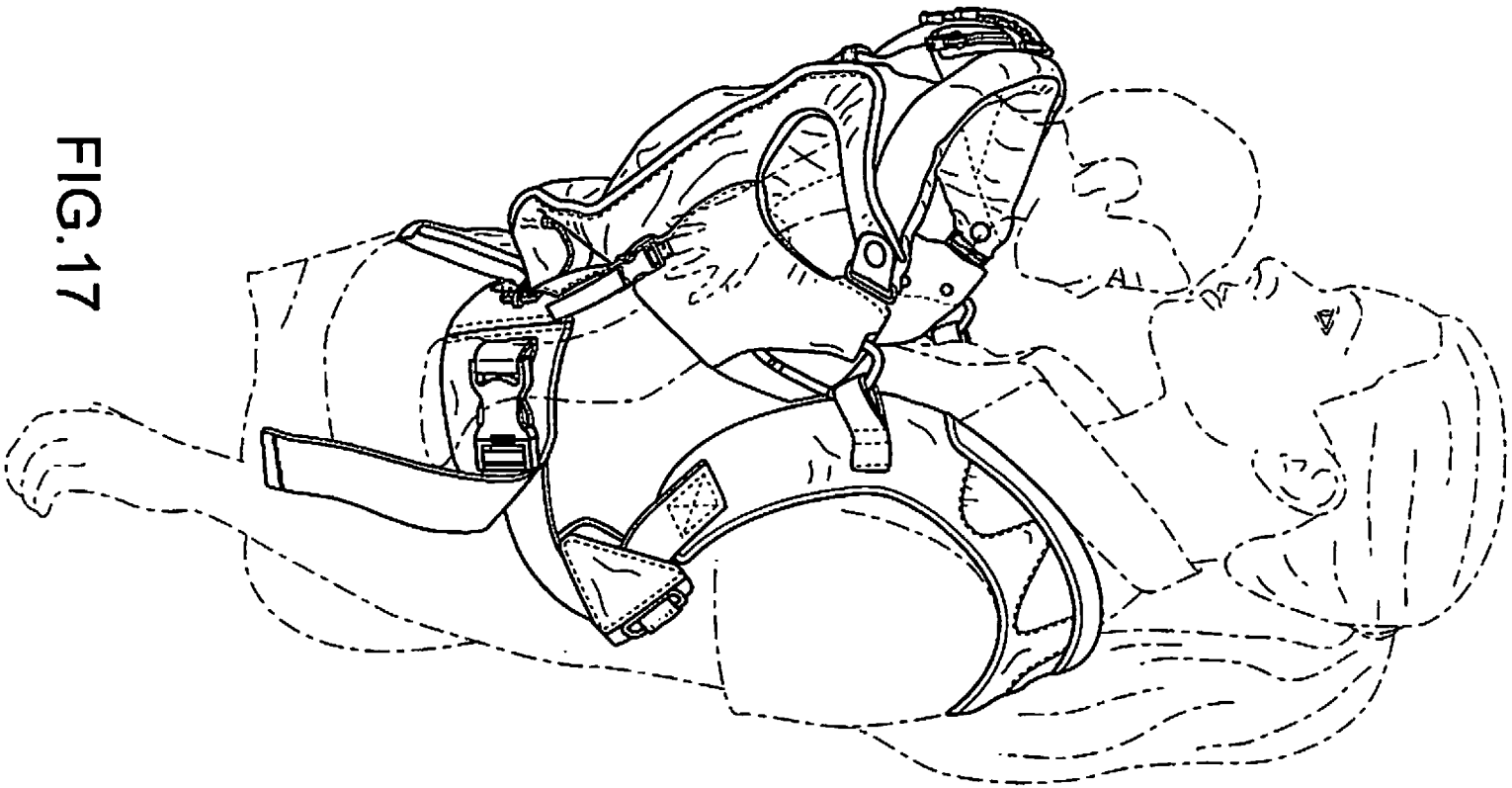
FIG. 17 is a perspective view of the front infant carrier of FIG. 1 demonstrating a further use of the carrier.

The front support pouch 13 includes a front storage pouch or pocket 29 with an intermediate elastic hem portion 30 extending transversely across to ensure articles do not fall out of the pouch 29. An upper pocket member 31, located along an upper portion of the front support 13, is designed to hold a removable cloth member 33. The cloth member 33 may be secured to the interior of the pocket member 31 with dual snaps 35, 35' as shown in FIG. 7. The cloth member 33 may be a simple fabric cloth providing a wiping or covering surface or may also possess sun-protective features. The cloth member 33 may be placed over the infant's head when there is direct sunlight or as a privacy measure to protect the infant from germs and unwanted attention. As stated previously, the cloth 33 is removable for washing or may be removed to provide additional storage space. The pocket member 31 is shown in one embodiment with a zipper 37, but other forms of closure may also be used. A loop member 36 is included as well on the front support portion for ease of attaching toys or keys for ready access. The loop member 36 may also be used to hang the front infant carrier 11 on a hook for storage. An upper padded hem 41 of the child support pouch 13 contains an adjusting member 39 that is designed to allow the upper hem 41 to be reduced in size to more securely surround an infant and provide privacy for infants, especially newborns. Further, the adjusting member 39 in combination with the upper hem 41 also provides a support for the arms and upper body of a larger infant that is facing forward as shown in FIG. 16. The upper hem 41 contains padding and extends almost the entire length of an upper portion of the child support pouch 13. The adjusting member 39 consists of dual lace or string members 42, 42' secured at opposite ends of the upper hem 41. Free ends 40 of the string members are placed through openings in a retainer or toggle device 43 so as to retain the desired shape of the hem. The free ends 40 may be pulled causing the upper hem 41 to constrict in length.

The front support pouch 13 converges into upper wing members 45, 45' on each side that form oblong or oval openings 51, 51' along opposite sides of the front carrier 11. Ends 46, 46' of the upper wing members 45, 45' are secured to the dual side support flaps 19, 19' with wing loops 49, 49' and releasable snap tabs 47, 47'. The releasable snap tabs 47, 47' may be undone, allowing the upper hem 41 to fall forward; or the snap tabs 47, 47' may be released and re-secured to the wing loops 49, 49' in a reverse manner from that described above as shown in FIG. 16.

Figure 8:
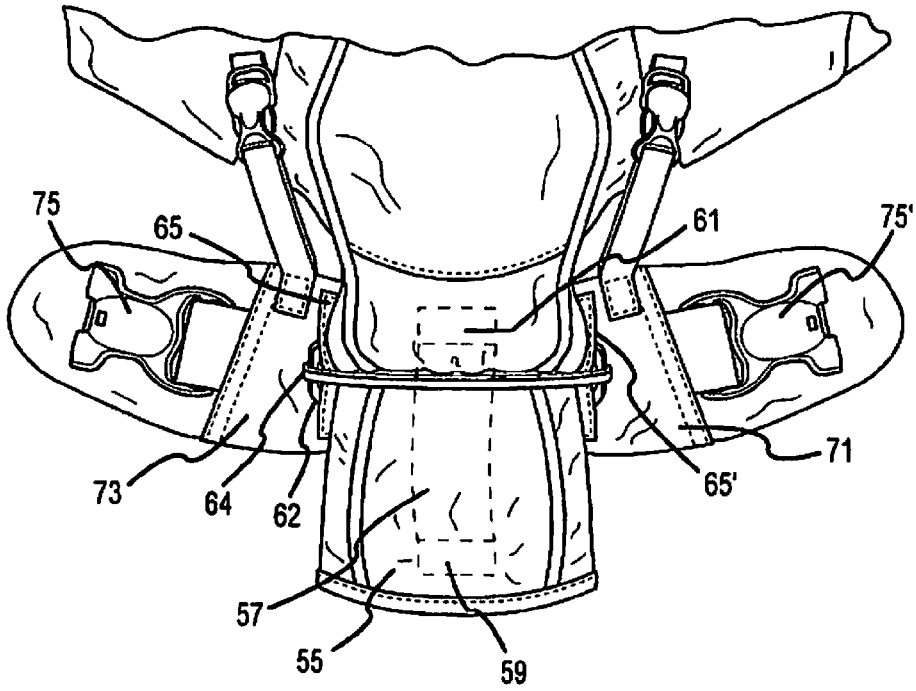
FIG. 8 is a front cut away view of the support portion of FIG. 5.

The front support pouch is also defined by a lower elongated tongue member 53 that contains a moderate amount of relatively stiff padding 55 that extends the entire length of the tongue member 53 and a retaining strap 57 comprising a length of material secured along the back surface of the tongue member as shown in FIGS. 2, 5, 6 and 8. The strap 57 is secured at two points, the lower attachment 59 and the upper attachment 61 as shown in FIG. 8. The strap 57 is inserted through an adjustment member 63, preferably a slider buckle defined by an outer frame 62 and a central bar 64. The adjustment member 63 is secured to the lower waist band 71 with cloth securing loops 65, 65' sewn to the lower waist band 71. The combination of the tongue member 53, the retaining strap 57 and the adjustment member 63 is designed to allow for lengthening or shortening the front carrier portion to accommodate a variety of infant sizes.

Figure 11:
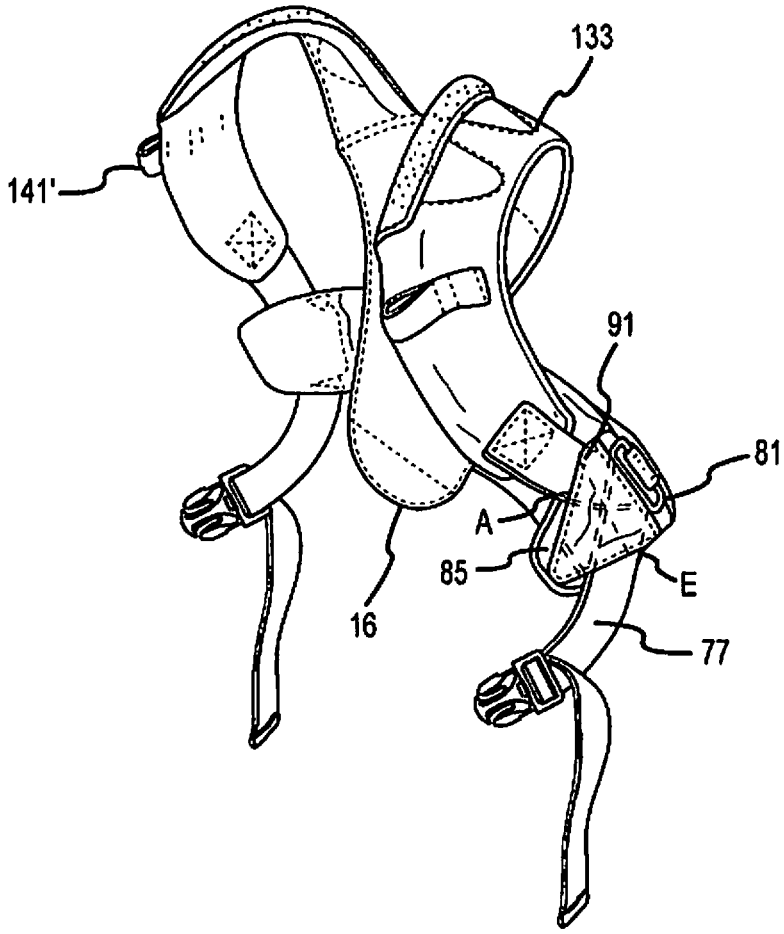
FIG. 11 is a side perspective view of the support system of the carrier of FIG. 1.
Figure 12:
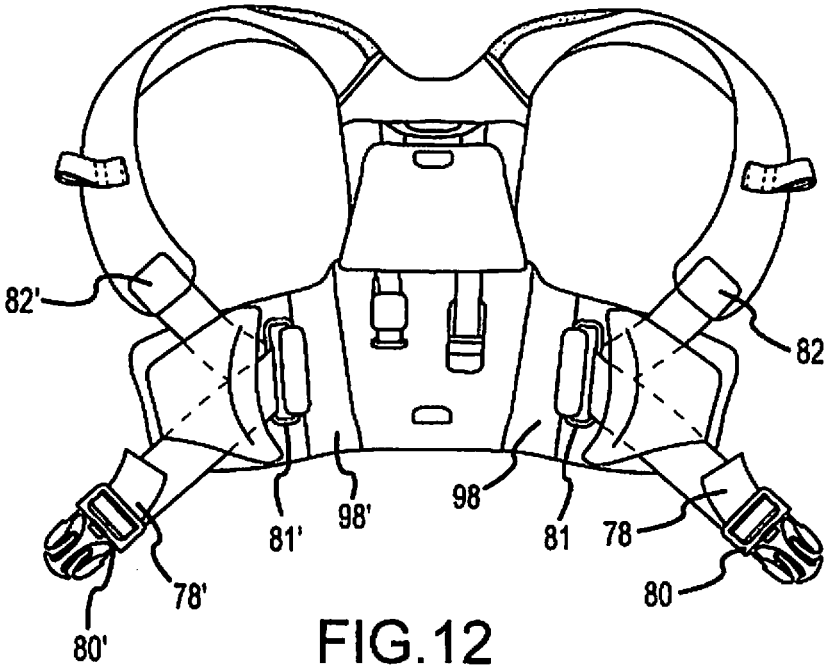
FIG. 12 is a front view of the support system of FIG. 1.
Figure 13:
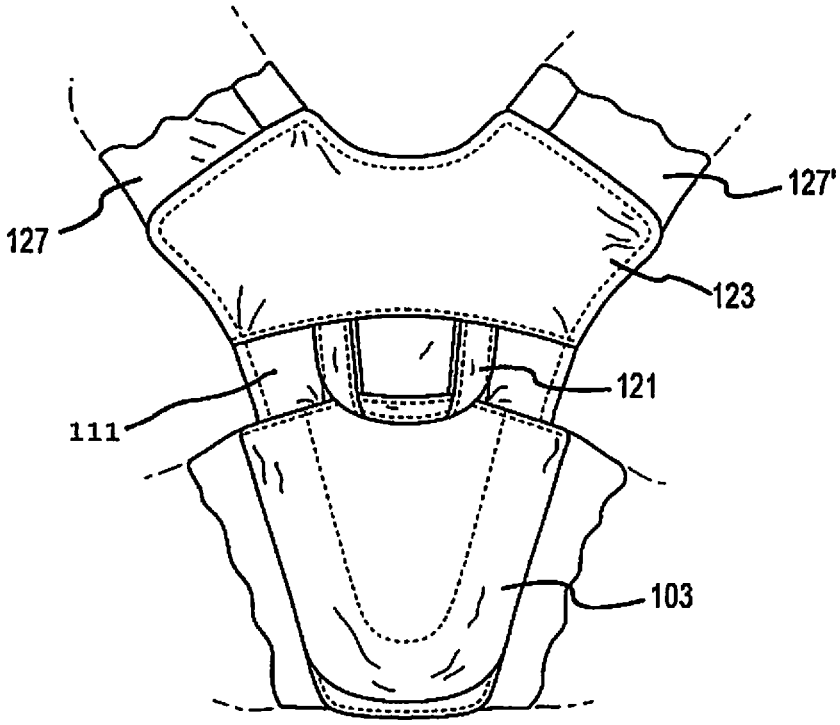
FIG. 13 is a cut-away view of a portion of the infant carrier of FIG. 12.
Figure 14:
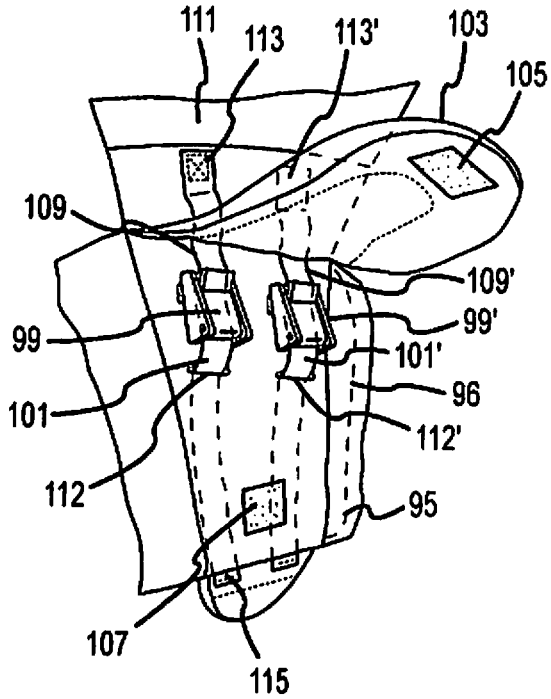
FIG. 14 is a side perspective cut away view of the back adjustment portion of the support system of FIG. 12.
Figure 15:
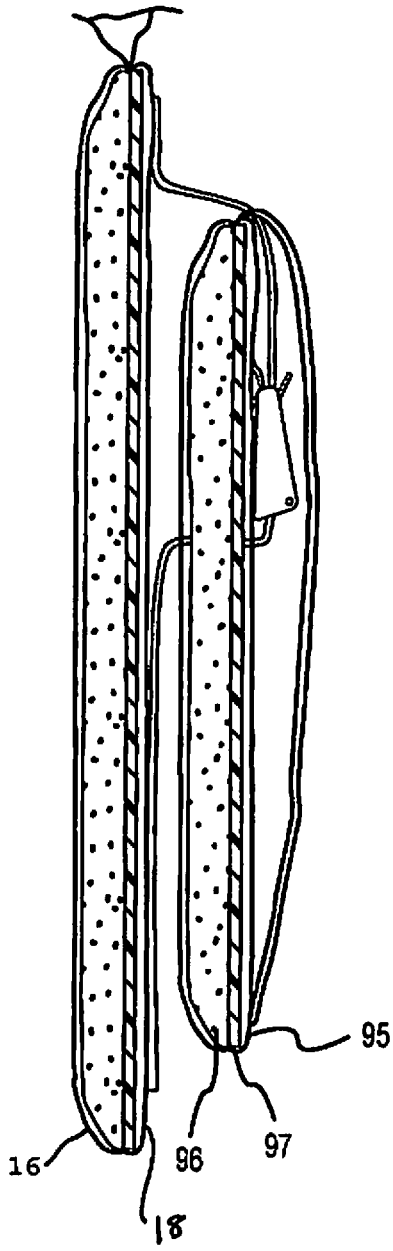
FIG. 15 is a sectional view of the back adjustment portion of FIG. 14.

The lower waist band 71 is defined by a length of fabric designed to partially encircle a front portion of the waist of the wearer. The lower band 71 preferably contains relatively stiff padding 73 throughout and has dual spring closure members 75, 75' with a lock release button 76, designed to attach the lower waist band 71 to dual, self adjusting continuous straps 77, 77' which extend from the back support system 15. The dual straps 77, 77' have free hemmed ends 78, 78' that are inserted through complementary closure/adjustment members 80, 80'. Opposite the free ends 78, 78', the straps 77, 77' are inserted through secured loop members 81, 81' and are secured to lower ends 82, 82' of shoulder strap members 127, 127'. The dual loop members 81, 81' are secured to padded, semi-rectangular reinforced panels 85, 85'. The straps 77, 77' have cover members 91, 91' that extend almost the entire length and width of the reinforced panels 85, 85'. The cover members 91, 91' act as a protective guide to prevent the continuous straps 77, 77' from tangling. The continuous straps 77, 77' are passed through the loop members 81, 81' at entry point E and the free ends 78, 78' exit at an angle A to the entry point E as shown in FIG. 11. The combination of the continuous straps 77, 77' and secured loop members 81, 81' allows the back support member to be self-adjusting by varying the entry and exit angle of the continuous straps 77, 77'. Shifting of position by the wearer causes the dual straps and loop members to automatically adjust by shortening and lengthening the dual straps.

The back support member 15, shown in FIGS. 11-15, is made up of a reinforced support system that allows for adjustment depending upon the height and weight of the wearer. The support member includes a generally Y-shaped panel 123 with upper shoulder straps 127, 127' and lower vertical section 111 each having a moderate amount of padding 96 and a reinforcing member 97 secured between inner and outer fabric layers 16 and as described previously for the front support pouch 13. There are also dual adjustable and locking closure members 99, 99' secured to a secondary panel 95 that allow for adjustment of the back support member. Dual adjustment straps 101, 101' are attached at terminal upper ends 113, 113' to the vertical padded, reinforced back section 111 and are designed to pass through dual strap feed portions 109, 109' of the secondary panel 95 and the closure members 99, 99'. The dual adjustment straps 101, 101' then pass through lower strap feed portions 112, 112' on the secondary back panel 95 and are secured along a lower end 115 of the back section 111. The back section 111 and secondary panel 95, in combination with the dual straps 101, 101' and the closure members 99, 99' form a vertically adjustable back support. The secondary back panel 95 includes a fabric cover panel 103 that may be secured with dual hook and loop closures 105 and 107. The back section 111 includes side elastic, stretchable panels 98, 98' that are designed to provide additional comfort and support to the wearer. Attached to each side elastic panel are the reinforced panels 85, 85', mentioned above, having the dual loop members 81, 81', forming a lower back support system.

Figure 1:
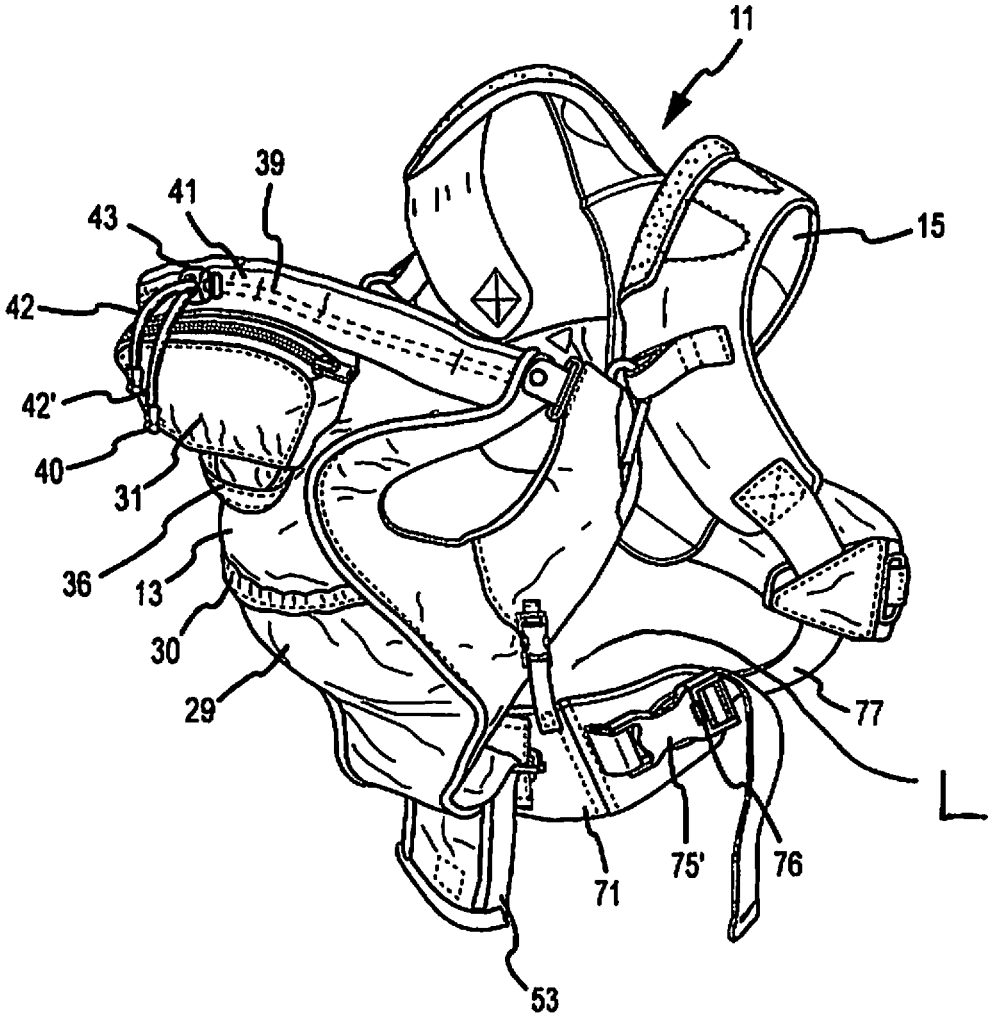
FIG. 1 is a perspective view of a front infant support carrier.
Figure 2:
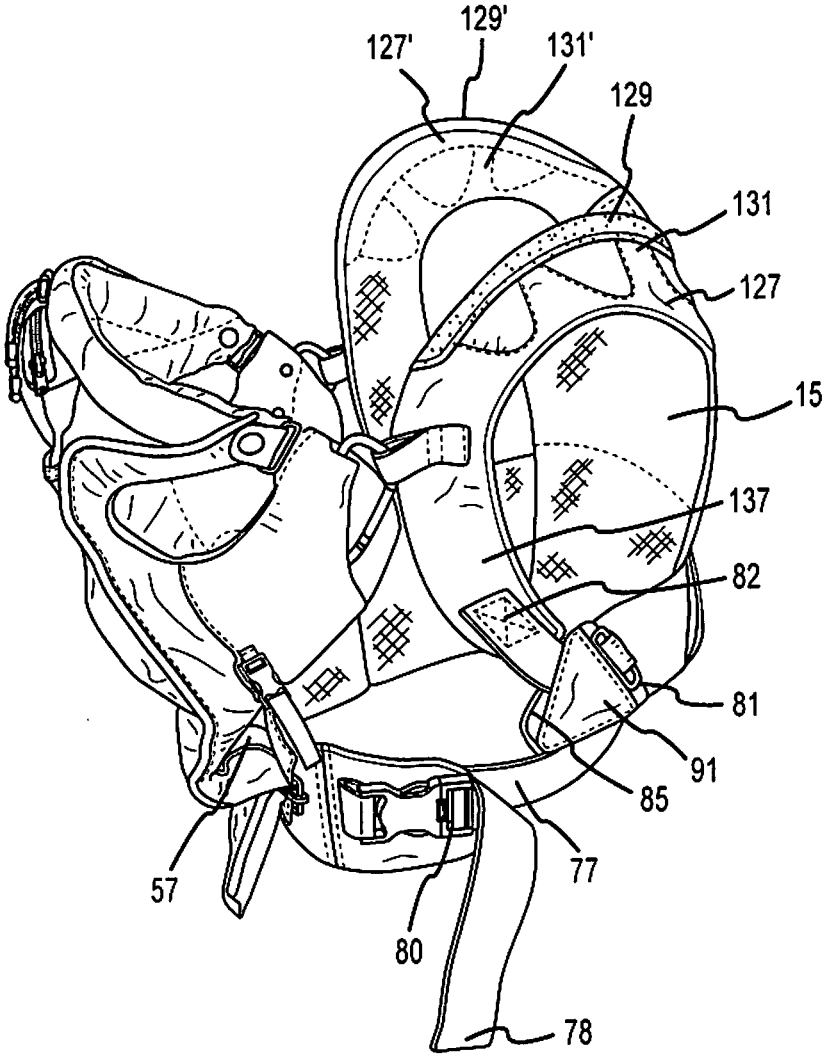
FIG. 2 is a side perspective view of the carrier of FIG. 1.
Figure 3:
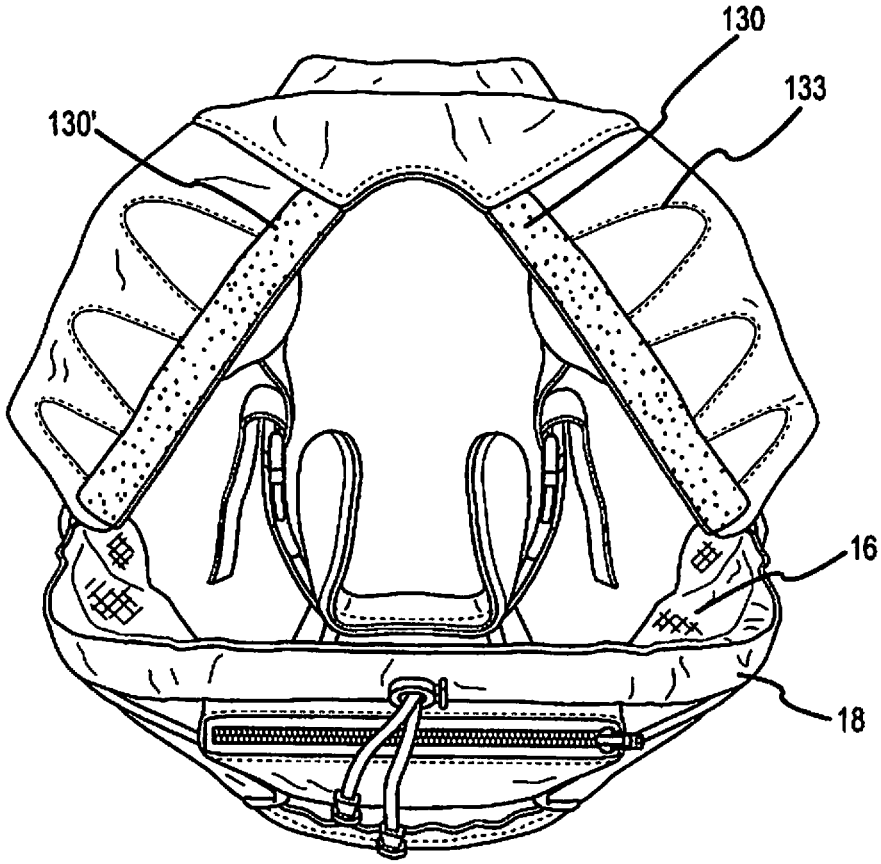
FIG. 3 is a top plan view of the carrier of FIG. 1.
Figure 4:
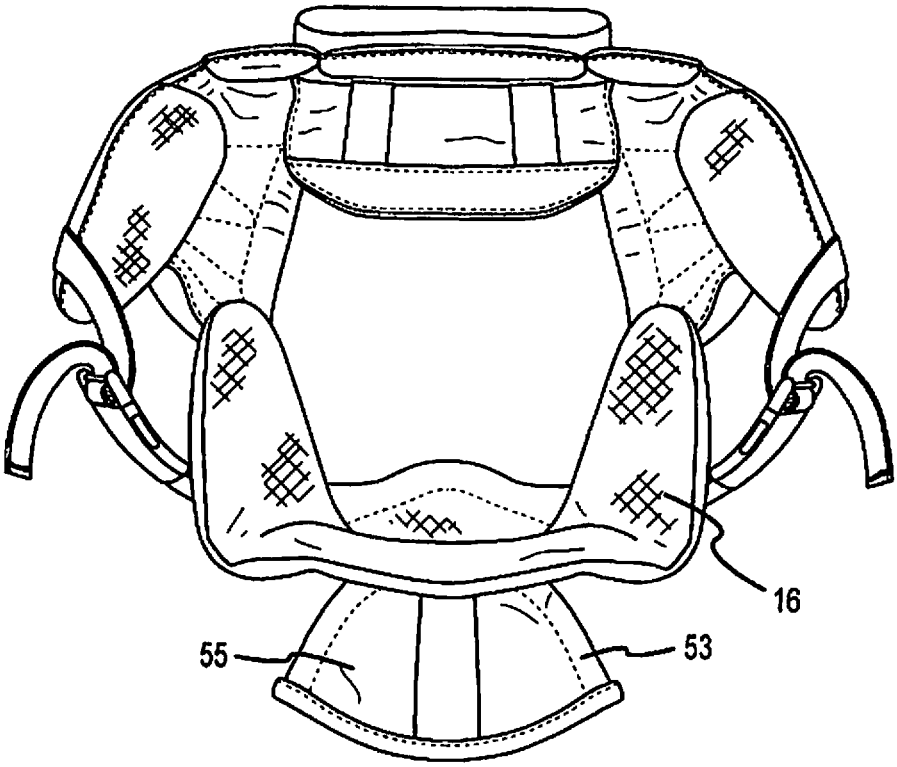
FIG. 4 is a bottom plan view of the carrier of FIG. 1.
Figure 5:
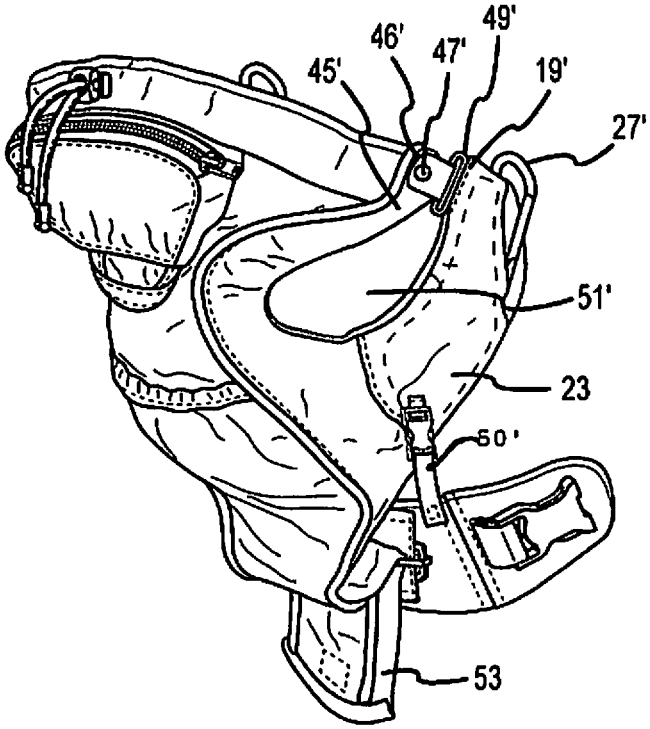
FIG. 5 is a side view of the support portion of the carrier of FIG. 1.

A loop member 121 is secured to the back section 111 allowing the carrier to be secured on a hook or the like for storage. The Y shaped panel 123 diverges into the dual shoulder strap members 127, 127' which are made up of padded members 131, 131', inside hems 129, 129', quilted portions 133, and hook and loop compatible strips 130, 130', as shown in FIGS. 2 and 3, for attachment of the cloth member 33. The quilted portions 133 and padded members 131, 131' are designed to provide maximum comfort for the wearer as well as maximum airflow and lift between the shoulders of the wearer and the shoulder strap members 127, 127'. The dual shoulder strap members 127, 127' are capable of being secured to the child support pouch with the attachment members 27, 27' and webbed loop members 141, 141'. The carabiners have the arm 26 that allows for one handed securing of the carabiner through the dual loops 141, 141' on the shoulder strap members 127, 127' to provide for a secure attachment as shown in FIG. 10. The dual shoulder strap members 127, 127' are designed to extend over the shoulders of the wearer and then extend downwardly and rearwardly toward the back panel 111. This configuration promotes equal weight distribution and proper posture in the wearer by pulling the wearer's shoulders back and allowing for extended wearing periods.

In use, the back support system 15 can be adjusted based on the height of the wearer. The cover 103 may be lifted to expose the dual locking members 99, 99'. The locking members 99, 99' may be released to allow for adjustment of the strap members 101, 101' passing through the panel 95. The panel 95 resembles a floating panel that can be adjusted vertically depending upon the needs of the wearer. Once adjusted, the locking members 99, 99' may be locked in place and the flap or cover 103 may be replaced. The back support system 15 is then placed on the wearer, with the dual shoulder strap members 127, 127' placed over the shoulders of the wearer, similar to a backpack. Next, the lower waist band 71 is secured partially around the waist of the wearer by buckling the dual closure/adjustment members 80, 80'. The free ends 78, 78' of the dual straps 77, 77' may be pulled outwardly to adjust the width of the waist belt to ensure a comfortable fit around the waist of the wearer and provide balancing of the weight of the infant. The front support pouch 13 may now be adjusted based on the size of the infant to be placed within the carrier. The lower elongated tongue member 53, including the retaining strap 57 may be adjusted downwardly or upwardly using the adjustment member 63. For larger infants, the tongue member 53 may be adjusted so the slider buckle rests along a lower portion of the strap 57, providing more room for larger infants. If a smaller infant is to be placed within the carrier, the tongue may be adjusted so the slider buckle rests along an upper portion of the strap 57.

The front support pouch 13 is then lifted inwardly towards the wearer and a single side of the pouch 13 is attached to the webbing loop on the back support member 15 with the carabiner 27. The clip gate arm 26 is forced inwardly and an upper portion of the clip is inserted through the loop 141 or 141' on the back support member. The gate is released and the loop is enclosed within the clip. The infant may then be placed within the carrier that has been formed between the child support pouch, the back support member and the wearer. The infant may be placed within the carrier, facing towards the wearer or away from the wearer. One leg of the infant is placed through the leg hole L on the side of the secured clip, while carefully holding the infant. The opposite side of the front support 13 may then be attached using the carabiner 27 and securing it to the webbing loop 141 or 141' as described previously. If the infant is placed facing the wearer, each side 45, 45' of the front support 13 may be secured using snaps 47, 47' or released as shown and discussed previously. Leg straps 49, 49' which extend vertically on opposite sides of the front support pouch 13 between the upper wings 45, 45' and the lower waist band 71, have releasable buckle members 50, 50' and may be fabricated of an elastic band, webbing or fabric, allow for adjustment and minimization of the leg opening L to prevent smaller infants from sliding through the opening.

Figure 18:
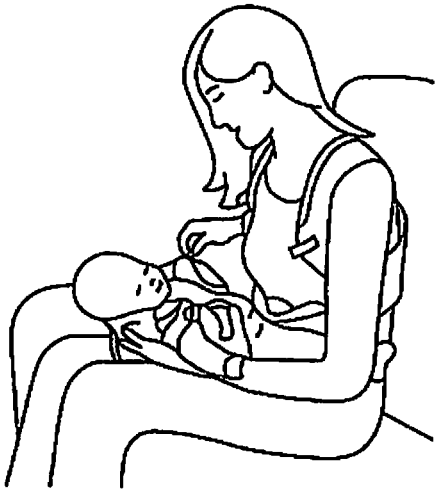
FIG. 18 is a side perspective view demonstrating one use of the carrier.

The configuration of the front support pouch in combination with the back support member, allows an infant to be carried next to the chest of the wearer without any type of wall or material separating the infant from the wearer. Further the stiffness of the padding and the addition of support panels prevent undue tangling of the carrier and allow for ease of use. The back support system has four points of contact with the front support pouch, the attachment members 27, 27' and the closure/adjustment members 80, 80'. It is possible to place the apparatus over the head of the wearer, secure the waist belt and place an infant within the front support pouch without disconnecting the carabiners or the releasable buckles. To remove the infant from the carrier, carefully hold the infant and release the dual head support snaps. Then undo each carabiner, supporting the infant through the entire process, and the infant can then be removed from the carrier as shown in FIG. 18. The carrier may then be removed from the wearer by releasing the waist buckles.

It is therefore to be understood that even though numerous characteristics and advantages of the embodiments shown and described have been set forth in the foregoing description, together with the details of the structure and function of the embodiments, the disclosure is illustrative only, and changes may be made within the principles of the embodiments to the full extent indicated by the broad general meaning of the terms and reasonable equivalents thereof.

We claim:

1. A front infant carrier comprising:

a back support member;

an adjustable, front pouch defined by a padded continuous panel, said continuous panel having dual side support flaps extending outwardly from and located on opposite sides of said continuous panel for attachment to the back support member;

said front pouch converging into upper wing members along opposite sides of the front carrier, said wing members adapted to be secured to said dual side support flaps; and a lower waist band secured to a lower portion of said front pouch having continuous adjustment straps secured to said back support member, said waist band defined by a length of fabric designed to partially encircle a front portion of the waist of the wearer;

wherein said front pouch includes means for adjusting a length of said front pouch to accommodate infants of different sizes, said means for adjusting comprising a lower elongated, padded tongue member, a retaining strap directly secured to a back surface of said tongue member, and an adjustment member provided on said retaining strap and secured to said lower waist band for upwardly or downwardly adjusting the retaining strap, whereby said adjustment member is disposed along a lower portion of the retaining strap for accommodating a larger infant and said adjustment member is disposed along an upper portion of the retaining strap for accommodating a smaller infant.

2. The front carrier according to claim 1 wherein said back support member has dual quilted shoulder straps forming a generally Y-shaped panel converging into a lower vertical section with a reinforcing member secured between inner and outer fabric layers, a secondary back support and said continuous adjustment straps.

3. The front carrier according to claim 2 wherein said lower vertical section includes dual adjustment straps and complementary closure members secured to said secondary back panel.

4. The front carrier according to claim 3 wherein said back support member and said secondary back panel form a vertically adjustable back support.

5. The front carrier according to claim 2 wherein said shoulder straps extend over the shoulders of the wearer and then extend downwardly and rearwardly toward said Y-shaped panel.

6. The front carrier according to claim 1 wherein said front pouch comprises an inner breathable mesh cover and an outer fabric cover.

7. The front carrier according to claim 6 wherein said padded continuous panel consists of uniformly spaced perforations extending throughout padding within said panel and which is covered by said inner and outer covers.

8. The front carrier according to claim 1 wherein said continuous adjustment straps are woven through dual loop members secured to shoulder straps.

9. The front carrier according to claim 8 wherein said dual loop members are secured to padded, semi-rectangular reinforced panels.

10. The front carrier according to claim 1 wherein said front support pouch and back support member are symmetrical about a vertical axis, having at least four points of contact between the front support pouch and the back support member.

11. The front carrier according to claim 1 wherein said adjustment member is secured to said lower strap member and slidably retains a lower portion of said tongue member within said adjustment member.

12. An infant carrier secured to the body of a wearer, the carrier comprising:

an adjustable front padded pouch defined by a breathable foam padding having an interior mesh cover and exterior cover, dual side members extending outwardly, and means for adjusting the length of said pouch;

a lower waist strap member secured to said adjusting means; and a back support member defined by dual shoulder straps converging into a reinforced panel that is secured to said back support member having means for lengthening said back support member and means for securing said back support member to said lower waist strap member;

wherein said means for adjusting comprising a lower elongated, padded tongue member, a retaining strap directly secured to a back surface of said tongue member, and an adjustment member provided on said retaining strap and secured to said lower waist band with securing loops for upwardly or downwardly adjusting the retaining strap, whereby said adjustment member is disposed along a lower portion of the retaining strap for accommodating a larger infant, and said adjustment member is disposed along an upper portion of the retaining strap for accommodating a smaller infant.

13. The infant carrier according to claim 12 wherein said front padded pouch includes an upper constricting member.

14. The infant carrier according to claim 12 wherein said front pouch includes a cover member.

15. The infant carrier according to claim 12 wherein said adjusting means include a slider buckle.

16. The infant carrier according to claim 12 wherein said back support member includes dual stretchable panels.

17. The infant carrier according to claim 12 wherein said lengthening means include dual strap members and dual locking closures secured to said reinforced panel and said back support panel.

18. The infant carrier according to claim 12 wherein said securing means include dual continuous strap members inserted through dual loop members.

* * * * *